United States Patent [19]

Ehrhardt et al.

[11] 4,018,307

[45] Apr. 19, 1977

[54] MECHANICAL AND HYDRAULIC INTERCONNECTION FOR CLUSTERED HYDRAULIC CYLINDERS

[75] Inventors: Benonie C. Ehrhardt, Park Forest; Dean A. Matthews, Homewood; Walter A. Pivarunas, Calumet Park, all of Ill.

[73] Assignee: Allis-Chalmers Corporation, Milwaukee, Wis.

[22] Filed: Nov. 10, 1975

[21] Appl. No.: 630,660

[52] U.S. Cl. ..... 187/9 E; 92/146

[51] Int. Cl.² ..... B66F 9/22

[58] Field of Search ..... 187/9 R, 9 E, 17; 254/89 H; 92/128, 146, 161; 214/660, 670–674

[56] References Cited

UNITED STATES PATENTS

| | | | |
|---|---|---|---|
| 2,232,449 | 2/1941 | Habenicht | 92/146 X |
| 2,678,746 | 5/1954 | Gibson | 17/9 E X |
| 2,821,264 | 1/1958 | Ulinski | 92/146 X |
| 3,489,249 | 1/1970 | Stammen | 187/9 E |

*Primary Examiner*—Johnny D. Cherry
*Assistant Examiner*—James L. Rowland
*Attorney, Agent, or Firm*—Robert C. Sullivan

[57] ABSTRACT

An improved structural arrangement for mechanically and hydraulically interconnecting a cluster of three hydraulic cylinders of the hydraulic jacks associated with the load carriage elevating and mast structure elevating functions of a forklift truck. The clustered cylinders include a centrally located "secondary" cylinder and two oppositely disposed "primary" cylinders symmetrically positioned contiguous to the centrally located secondary cylinder. Each cylinder has a corresponding attachment block rigidly secured thereto, each attachment block being provided with a hydraulic passage therethrough which communicates with an aligned hydraulic passage through the wall of its corresponding cylinder. An interconnecting block having an internal hydraulic manifold and outlet ports which are adapted to be aligned with the hydraulic passages of the respective attachment blocks and corresponding hydraulic passages through the walls of the respective cylinders, and thus to hydraulically communicate with the interior of the respective cylinders, is adapted to be bolted to the attachment blocks of the respective cylinders. An important feature of the construction is the "shear ledge" construction for supporting the structural load on the interconnecting block to relieve the shear load on the bolts which secure the interconnecting block to the attachment blocks of the respective hydraulic cylinders. In accordance with this shear ledge construction the interconnecting block is provided with a welded plate defining an overhanging shoulder which seats on the upper surface of the attachment block of the centrally located secondary cylinder, and the attachment blocks of the oppositely disposed primary cylinders are recessed to define oppositely disposed shoulders which seat on the upper surface of the interconnecting block.

6 Claims, 7 Drawing Figures

MECHANICAL AND HYDRAULIC INTERCONNECTION FOR CLUSTERED HYDRAULIC CYLINDERS

BACKGROUND OF THE INVENTION

1. Field of the Invention

This invention relates to hydraulic jacks for use in elevating the load carriage and the mast structure of a forklift truck, and more particularly to an improved structural arrangement for mechanically and hydraulically interconnecting a cluster of hydraulic cylinders of the hydraulic jacks associated with the load carriage elevating and mast structure elevating functions of a forklift truck.

2. Description of the Prior Art

It has been known in the prior art of hydraulic controls for forklift trucks to provide a cluster of three hydraulic cylinders which are mechanically and hydraulically interconnected in such manner that hydraulic fluid admitted to the interior of a secondary cylinder passes through a hydraulic interconnection between the cylinders to a pair of contiguously disposed primary cylinders to cause movement of the forklift load carriage relative to the supporting mast structure; and whereby after the load carriage has reached the limit of its vertical movement on the portion of the mast structure upon which the load carriage is supported, further admission of hydraulic fluid to the secondary cylinder causes a vertical elevating movement of the portion of the mast structure on which the load carriage is supported to thereby further vertically elevate the load carriage relative to the chassis structure of the forklift truck. Clustered hydraulic cylinders which cooperate to assist in the vertical displacement of the forklift load carriage and of the mast structure of the forklift truck in the general manner just described are shown, for example, by U.S. Pat. Nos. 2,678,746 issued to C. D. Gibson on May 18, 1954, 2,821,264 issued to B. I. Ulinski on Jan. 28, 1958; and 3,489,249 issued to H. A. Stammen on Jan. 13, 1970. All three of the United States Patents just listed show two-section masts associated with a cluster of three hydraulic jacks, including a fixed or primary mast section which is fixed relative to the forklift vehicle chassis and a secondary mast structure which is telescopically movable relative to the primary or fixed mast structure. A forklift truck which is provided with a cluster of three mechanically and hydraulically interconnected hydraulic cylinders but in which the forklift truck is provided with a triple section mast including an outer mast section which is fixed against vertical movement relative to the vehicle chassis and also with an inner mast section and an intermediate mast section which are vertically movable relative to each other and also relative to the fixed outer mast section is shown in co-pending U.S. patent application Ser. No. 536,029 of Benonie C. Ehrhardt, entitled "Multiple Hose Guide Arrangement for a Lift Truck," filed Dec. 23, 1974, now U.S. Pat. No. 3,968,859, and assigned to the same assignee as the present application.

A disadvantage of the hydraulic cylinder cluster arrangement shown by the aforementioned prior art is that the plurality of cylinders constituting the cluster are rigidly mechanically connected together as by welding in such manner that the individual cylinders of the cluster cannot be separately removed for replacement or servicing, and if one damaged hydraulic cylinder of the cylinder cluster of the prior art requires replacement, it is necessary to replace the entire cluster assembly. Similarly, in the prior art if it was necessary to service one of the hydraulic cylinders it was necessary to remove the entire cluster of cylinders in order to service a single hydraulic cylinder.

OBJECTS OF THE INVENTION

Accordingly, it is an object of the invention to provide for use with a cluster of hydraulic cylinders associated with a forklift truck an interconnecting arrangement which mechanically and hydraulically interconnects the plurality of cylinders in such manner as to permit removal of individual cylinders from the cluster of cylinders for servicing and/or replacement of the individual cylinders.

It is a further object of the invention to provide for use in conjunction with a cluster of hydraulic cylinders associated with a forklift truck a mechanical and hydraulic interconnection arrangement between the hydraulic arrangement cylinders in which the mechanical construction of the interconnection includes shear ledges for mechanical load transfer, and in which the individual cylinders of the cluster can be individually removed for servicing and/or replacement.

In achievement of these objectives, there is provided in accordance with an embodiment of the invention an improved structural arrangement for mechanically and hydraulically interconnecting a cluster of three hydraulic cylinders of the hydraulic jacks associated with the load carriage elevating and mast structure elevating functions of a forklift truck. The clustered cylinders include a centrally located secondary cylinder and two oppositely disposed primary cylinders symmetrically positioned contiguous to the centrally located secondary cylinder. Each cylinder has a corresponding attachment block rigidly secured thereto, each attachment block being provided with a hydraulic passage therethrough which communicates with an aligned hydraulic passage through the wall of its corresponding cylinder. An interconnecting block having an internal hydraulic manifold and outlet ports which are adapted to be aligned with the hydraulic passages of the respective attachment blocks and corresponding hydraulic passages through the walls of the respective cylinders, and thus to hydraulically communicate with the interior of the respective cylinders, is adapted to be bolted to the attachment blocks of the respective cylinders. An important feature of the construction is the shear ledge construction for supporting the structural load on the interconnecting block to relieve the shear load on the bolts which secure the interconnecting block to the attachment blocks of the respective hydraulic cylinders. In accordance with this shear ledge construction, the interconnection block is provided with a welded plate defining an overhanging shoulder which seats on the upper surface of the attachment block of the centrally located secondary cylinder, and the attachment blocks of the oppositely disposed primary cylinders are recessed to define oppositely disposed shoulders which seat on the upper surface of the interconnecting block.

Further objects and advantages of the invention will become apparent from the following description taken in conjunction with the accompanying drawings in which:

DESCRIPTION OF THE PREFERRED EMBODIMENT

Figures 1, 2:
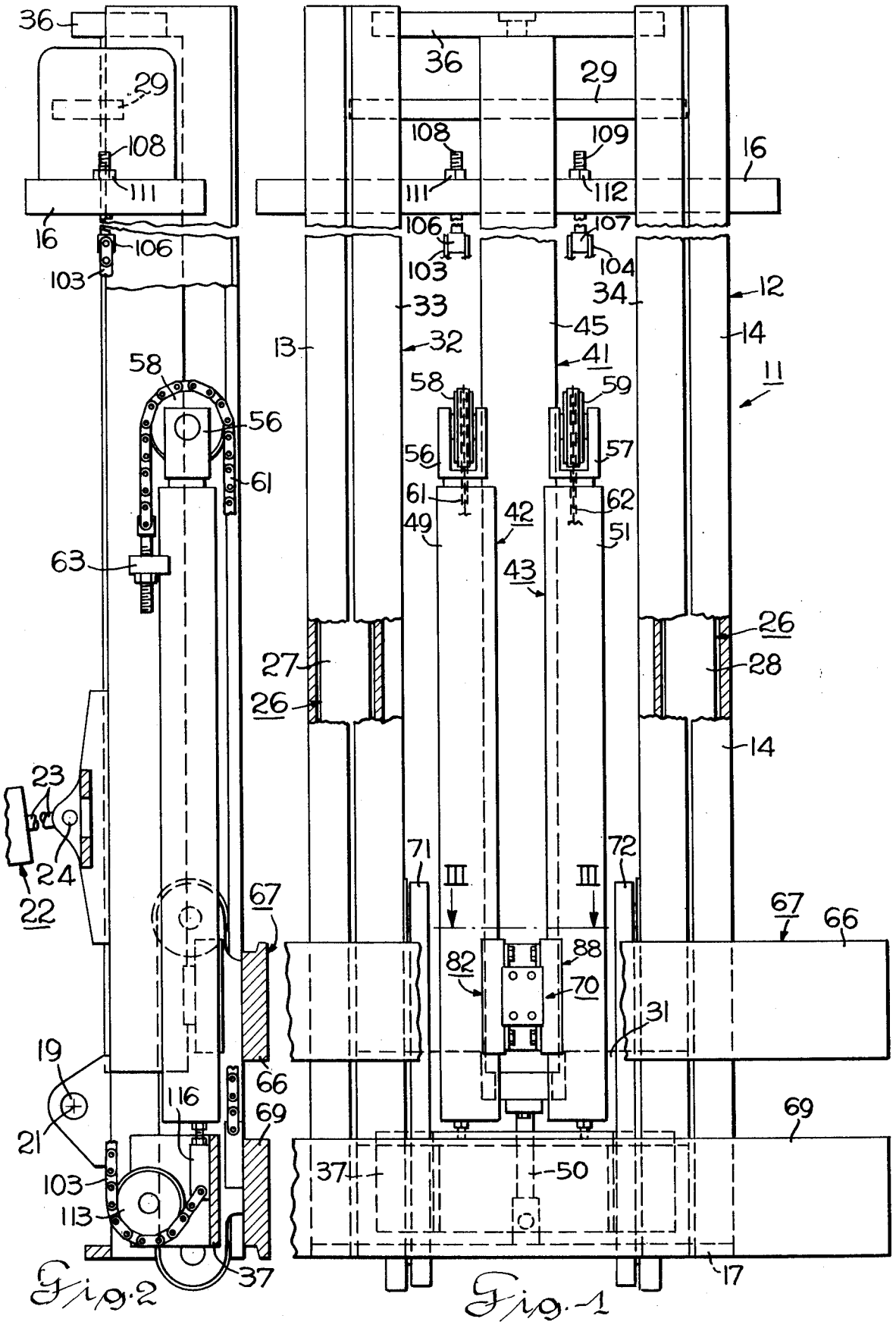
FIG. 1 is a view in vertical elevation of a portion of a forklift truck including a cluster of three hydraulic cylinders which are mechanically and hydraulically interconnected with each other in accordance with the invention.
FIG. 2 is a view in end elevation of the portion of the forklift truck illustrated in FIG. 1.

Referring now to the drawings, and more particularly to FIGS. 1 and 2, there is shown a triple section mast generally indicated at 11 for a forklift truck similar to the triple section mast described in the aforementioned co-pending patent application Ser. No. 536,029 of Benonie C. Ehrhardt, filed Dec. 23, 1974, now U.S. Pat. No. 3,968,859, and to which application reference is hereby made for a more detailed description of the triple section mast structure than will be given in the present application. However, for the purpose of providing a general orientation of the combined mechanical and hydraulic interconnecting means for the hydraulic cylinder cluster associated with the triple section mast 11, a brief description of the triple section mast will now be provided.

The triple section mast 11 includes outer mast section generally indicated at 12 and having a pair of vertical channel members 13, 14 rigidly interconnected at the upper ends by a transverse brace 16 and at the bottom end thereof by a similar transverse brace 17. Outer mast section 12 is pivotally connected to the main frame of the lift truck by a pair of pins 19, only one of which is shown, for tilting movement about a transverse axis 21 by a pair of tilt jacks 22, only one of which is shown. The rod 23 of the tilt jack 22 is pivotally connected to the outer mast section 12 by a pivot pin 24. The triple section mast 11 also includes an intermediate mast section 26 having a pair of upright I-beams 27, 28 rigidly connected at their upper ends by a transverse brace 29 and at their lower ends by a transverse brace 31. The outer mast section 12 rotatably mounts rollers (not shown) which guidingly engage the intermediate mast section 26.

The triple section mast 11 further includes an inner mast section generally indicated at 32 having a pair of I-beam uprights 33, 34 which are rigidly interconnected at their upper ends by cross brace 36 and at their lower ends by a curved brace 37. Rollers (not shown) on the intermediate mast section 26 guidingly engage the inner mast section 32.

Hydraulic lift jack means are provided for selectively extending and contracting the telescoping mast sections 12, 26, 32 such means taking the form of a lift jack cluster comprising a central vertical jack 41 and a pair of short vertical jacks 42, 43. The hydraulic jacks 41, 42, 43 are single acting and the cylinders 45, 49, 51 of the respective hydraulic jacks 41, 42, 43 are rigidly mechanically interconnected to each other and also hydraulically interconnected with each other by the mechanical and hydraulic interconnection block 70 in accordance with the invention which will be described more fully hereinafter.

The upper end of cylinder 45 of central jack 41 is connected to cross brace 36 of the inner mast section 32 and the piston 47 of central jack 41 is connected to cross brace 31 which connects the lower ends of opposite I-beam uprights 27, 28 of intermediate mast section 26. Pressure fluid is supplied to the lower end of the central jack 41 by means of a feed tube 50 mounted at its lower end in lower cross brace 17 of outer mast section 12. The upper ends of pistons 53, 54 of the respective hydraulic jacks 42, 43 have respectively secured thereto U-shaped brackets 56, 57 to which chain support pulleys 58, 59 are rotatably mounted. Elongated flexible load support members in the form of chains 61, 62 are trained over the support pulleys 58, 59 with their rear ends connected to the back side of the cylinders 49, 51 of hydraulic jacks 42, 43 by brackets 63, only one of which is shown in FIG. 2. The lower front end of the chains 61, 62 are connected to the back side of the lower transverse plate 69 of a vertically movable carriage 67 by a pair of brackets (not shown). The carriage 67 also includes an upper transverse plate 66, plates 66, 69 being rigidly interconnected by a pair of upright brackets 71, 72 welded thereto.

A pair of elongated load carrying members in the form of lift chains 103, 104 have their upper rear ends connected to mounting lugs 106, 107 having threaded studs 108, 109 extending through vertical openings in cross brace 16 of the outer mast section 12. A pair of nuts 111, 112 on studs 108, 109 secure the lugs 106, 107 to the cross brace 16. The chains 103, 104 extend downwardly from their connection with the cross brace 16 and around the lower half of a pair of load pulleys 113, 114 (not shown) and then extend upwardly at the front of the pulleys 113, 114 to terminal blocks 116, 117 (not shown) which are secured by welding to the lower transverse brace 37 of inner mast section 32.

When hydraulic pressure fluid is delivered to the lift jacks, the pistons 53 and 54 of carriage lift jacks 42, 43 will be extended causing the carriage 67 to be elevated on the inner mast section 32 while the intermediate and outer mast sections 26, 12 remain stationary. When the pistons 53, 54 reach the limit of their stroke, the carriage will be at the top of the inner mast section 32 and further delivery of pressure fluid to the lift jack cluster 41, 42, 43 will cause central jack 41 to expand causing inner mast section 32 to be moved upwardly relative to the intermediate mast section 26. As the inner mast section 32 moves upwardly relative to the intermediate mast section 26, the load carrying chains 103, 104 will elevate the intermediate mast section 26 on the stationary outer mast section 12.

DESCRIPTION OF COMBINED MECHANICAL AND HYDRAULIC INTERCONNECTION BETWEEN HYDRAULIC CYLINDERS

Figure 3:
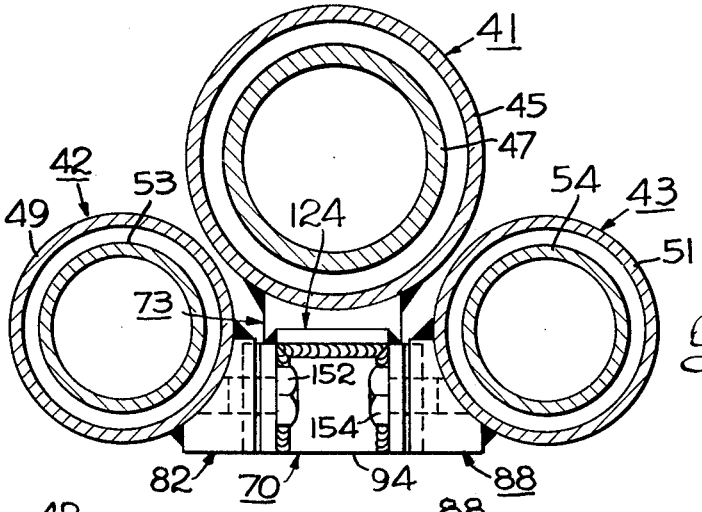
FIG. 3 is a view taken in transverse section along line III—III of FIG. 1.
Figure 6:
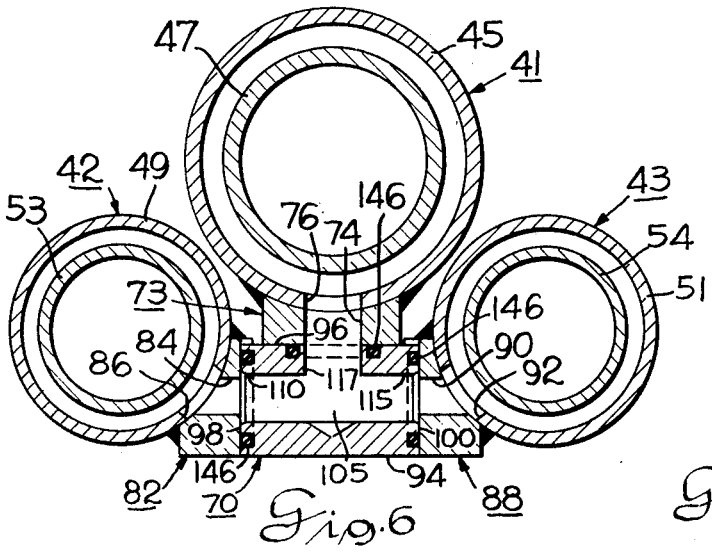
FIG. 6 is a view in transverse section taken along line VI—VI of FIG. 4.
Figure 7:
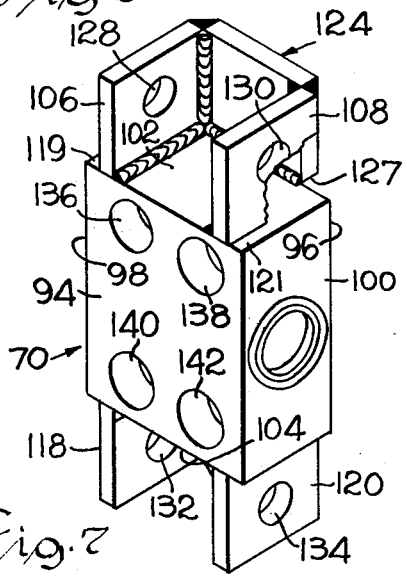
FIG. 7 is a perspective view of the mechanical and hydraulic interconnecting means for the cluster of hydraulic cylinders.

A combined mechanical and hydraulic interconnection means generally indicated at 70 is provided to mechanically and hydraulically interconnect the long vertical cylinder 45 of the secondary hydraulic jack 41 and the shorter vertical cylinders 49 and 51 of the two shorter primary jacks 42 and 43. The mechanical and hydraulic interconnecting means 70 is mounted contiguous the lower end of the respective cylinders 45, 49 and 51 as best seen in the view of FIG. 1. As can best be seen in the views of FIGS. 3 and 6, the three cylinders 45, 49 and 51 are arranged in a generally triangular-shaped cluster with the larger diameter secondary cylinder 45 being positioned rearwardly of the two smaller diameter primary cylinders 49 and 51, with respect to the views shown in FIGS. 3 and 6, and with the distance between the outer peripheries of the two spaced primary cylinders 49 and 51 being less than the diameter of the larger diameter secondary cylinder 45.

The larger diameter secondary cylinder 45 has rigidly secured to an outer peripheral surface thereof as by welding a block member generally indicated at 73 having a hydraulic passage 74 therethrough which cooperates with an aligned passage 76 through the wall of cylinder 45 of secondary hydraulic jack 41, whereby to permit hydraulic communication with a cooperating hydraulic passage and manifold in the interconnecting member 70 to be described.

In a similar manner, cylinder 49 of primary hydraulic jack 42 has rigidly secured to a portion of the outer peripheral surface thereof which faces the cylinder 51 of the oppositely disposed primary jack 43 a block member 82 which is provided with a hydraulic passage 84 therethrough which is adapted to cooperate with an aligned hydraulic passage 86 in the wall of cylinder 49 of primary hydraulic jack 42, whereby to permit hydraulic communication between the interior of cylinder 49 and the hydraulic manifold in interconnecting means 70 as will be described hereinafter more fully in detail.

In a similar manner, the oppositely disposed hydraulic cylinder 51 of primary hydraulic ram 43 has rigidly secured to an outer peripheral surface thereof as by welding a block member 88 which is provided with a hydraulic passage 90 therethrough which is aligned with a hydraulic passage 92 in the contiguous wall of hydraulic cylinder 51 of primary hydraulic ram 43 whereby to permit hydraulic communication between the interior of hydraulic cylinder 51 and a hydraulic manifold on the interior of interconnecting block 70 as will be described in more detail hereinafter.

The interconnecting block generally indicated at 70 which is adapted to be mechanically and hydraulically connected to the attachment blocks 73, 82, and 88 of the respective hydraulic cylinders 45, 49, and 51 is of generally rectangular horizontal cross-section and comprises a forward wall 94, a rear wall 96, oppositely disposed vertical side walls 98 and 100 and top and bottom walls 102 and 104, the six walls enumerated cooperating to form a rectangular cross-section block member which is solid except for a hydraulic manifold provided therein, hydraulic passage means in block 70 connected to the hydraulic manifold, and bolt passages through block 70, all of which will be described more fully hereinafter.

Hydraulic manifold 105 in the interior of interconnecting block 70 opens through a hydraulic outlet port 110 in side wall 98 of interconnecting block 70, passage 110 being in hydraulic communication with passage 84 in block 82 connected to cylinder 49, and also with the aligned hydraulic passage 86 in the wall of cylinder 49. In a similar manner, hydraulic manifold 105 is connected in fluid communication with the interior of cylinder 51 of primary hydraulic jack 43 through a hydraulic port 115 in side wall 100 of interconnecting block 70 which communicates with hydraulic passage 90 in block 88 connected to the exterior surface of cylinder 51, and thence communicates through the hydraulic passage 92 in the wall of cylinder 51 to provide hydraulic communication between manifold 105 and the interior of cylinder 51.

In a similar manner, manifold 105 hydraulically communicates with the interior of cylinder 45 of secondary hydraulic ram 41 through a hydraulic port 117 opening onto rear wall 96 of interconnecting block 70, hydraulic port 117 communicating with hydraulic passage 74 in block 73 secured to the wall of cylinder 45, and also with hydraulic passage 76 in the wall of cylinder 45 of secondary hydraulic jack 41, whereby to permit hydraulic communication between the interior of manifold 105 and the interior of cylinder 45.

The interconnecting member generally indicated at 70 also comprises a pair of upper side wall extensions 106 and 108 which are welded or otherwise rigidly secured to the upper surface of top wall 102 of interconnecting member 70 and are inset laterally from the outer surfaces of the respective opposite side walls 98 and 100 to define front-to-rear extending shoulders or ledges 119 and 121, respectively, on upper wall 102 of interconnecting member 70 for a purpose to be hereinafter described. A rear wall extension generally indicated at 124 which is of the same height as the side wall extensions 106 and 108 extends between the side wall extensions 106 and 108 in a plane which lies rearwardly relative to the views of FIGS. 3–6, inclusive, of the plane of top wall 102 and rear wall 96 of interconnecting block 70 to define an overhanging shoulder 127 which is adapted to seat on the upper surface of block 73 which is secured to the outer peripheral surface of hydraulic cylinder 45 of secondary hydraulic ram 41. Rear wall extension 124 is of substantially the same length as the distance between the inner wall surfaces of the oppositely disposed side wall extensions 106 and 108. The rear wall extension 124 is suitably welded to side wall extensions 106 and 108 and to top wall 102 of interconnecting block 70.

Similarly, at the lower end of interconnecting block 70 relative to the view shown in the drawings, a pair of oppositely disposed wall extensions 118 and 120 are provided and are offset inwardly from the outer surfaces of the respective side walls 98 and 100 in a manner similar to the upper side walls 106 and 108. A lower rear wall extension 122 is provided similar to the upper rear wall extension 124 previously described and lies rearwardly of the side walls 98 and 100 in the same manner as the upper rear wall extension 124 previously described. The lower side wall extensions 118 and 120 and the lower rear wall extension 122 are weldedly secured to the interconnecting block 70 in a manner similar to the welded connections of the upper side wall extensions 106 and 108 and the upper rear wall extension 124 previously described.

The upper side wall extensions 106 and 108 are provided with bolt-receiving apertures 128 and 130, respectively; similarly, the lower side wall extensions 118 and 120 are provided with bolt-receiving apertures 132 and 134, respectively. Similarly, the main body of interconnecting block 70 is provided with a pair of bolt-receiving apertures 136 and 138 lying in a plane above the hydraulic manifold 105; and with a pair of bolt-receiving apertures 140 and 142 lying in a plane below hydraulic manifold 105.

When the mechanical and hydraulic interconnecting block 70 is properly located relative to the cylinders 41, 42 and 43, as shown in the assembled views of the drawings, the flat surface of rear wall 96 of the interconnecting block 70 and the flat surfaces of side walls 98 and 100 of interlocking block 70 abut against mating and cooperating flat wall surfaces of the respective blocks 73, 82 and 88 which are secured to the respective cylinders 45, 49 and 51, in such manner that hydraulic ports 117, 110 and 115 of hydraulic manifold 105 of interconnecting block 70 are in registry with the corresponding passages 74, 84 and 90 of the respective attachment blocks 73, 82 and 88 of the respective cylinders 45, 49 and 51, whereby hydraulic manifold 105 on the interior of interconnecting block 70 fluidly communicates with the interior of the respective hydraulic cylinders 45, 49 and 51 through the respective aligned hydraulic passages 76, 86 and 92 through the walls of the respective cylinders 45, 49 and 51. An O-ring seal each indicated at 146 is provided at the junction of each of the fluid ports 110, 115 and 117 of hydraulic manifold 105 with its corresponding aligned fluid passage in the corresponding attachment block 82, 88 and 73.

Figure 4:
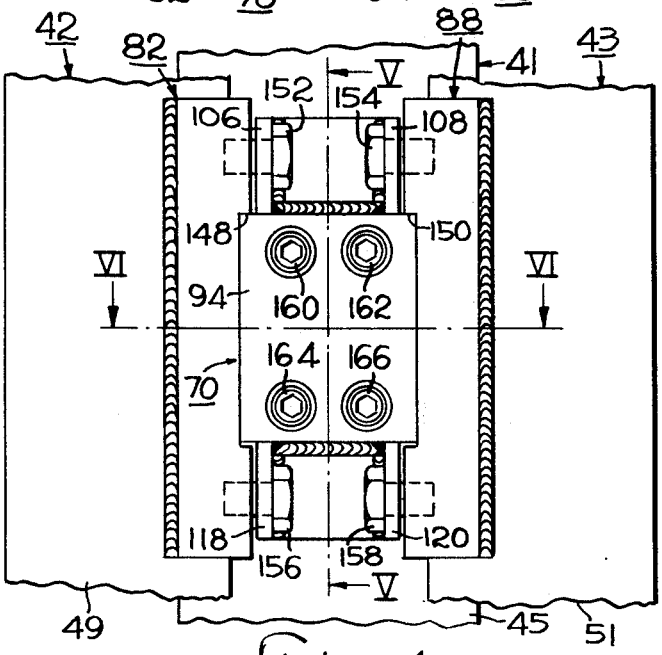
FIG. 4 is an enlarged view of a portion of the assembly as viewed in FIG. 1 showing details of the mechanical and hydraulic interconnecting means between the cluster of hydraulic cylinders.
Figure 5:
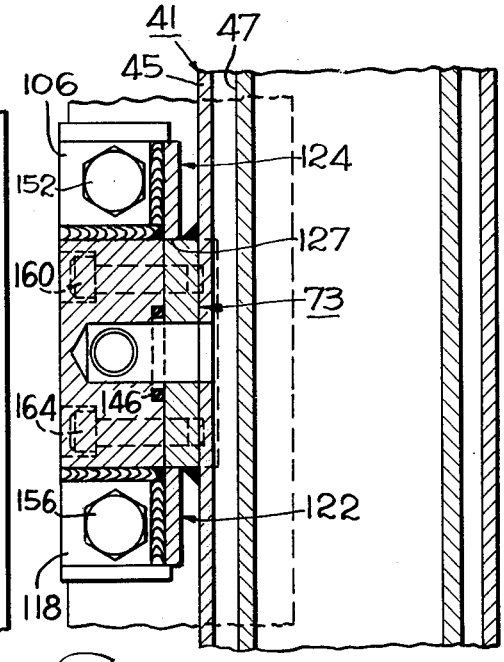
FIG. 5 is a view taken along vertical section line V—V of FIG. 4.

In the assembled position of interconnecting block 70, as seen in the drawings, the rear wall extension 124 which overhangs the rear surface of the main body portion of interconnecting block 70 seats on the upper surface of the attachment block 73 secured to the outer surface of cylinder 45 of secondary hydraulic jack 41. Also, as best seen in the view of FIG. 4, it will be noted that attachment blocks 82 and 88 which are secured to the outer surface of the respective primary hydraulic cylinders 49 and 51 are recessed or notched for a height of just slightly greater than the height of forward wall 94 of the main body of interconnecting block 70 whereby to define shoulders 148 and 150 on the respective attachment blocks 82 and 88 of hydraulic cylinders 49 and 51, which shoulders 148 and 150 respectively seat on the oppositely disposed ledges 119 and 121 defined by the oppositely disposed surface portions of top wall 102 of interconnecting block 70 which lie outwardly of the respective side wall extensions 106 and 108. The respective upper side wall extensions 106 and 108 are bolted to the respective attachment blocks 82, 88 of hydraulic cylinders 49, 51 by means of threaded bolts 152 and 154, respectively, which pass through bolt-receiving apertures 128, 130 in side wall extensions 106, 108 and into threaded apertures in the respective attachment blocks 82 and 88. Similarly, the lower side wall extensions 118 and 120 are bolted to the respective attachment blocks 82 and 88 of hydraulic cylinders 49 and 51 by means of bolts 156 and 158 which pass through apertures 132 and 134 in the respective lower side wall extensions 118 and 120 and into threaded engagement with the respective attachment blocks 82 and 88.

Also, interconnecting block 70 is bolted to attachment block 73 carried by hydraulic cylinder 45 by means of bolts 160, 162, 164 and 166 which pass through the respective apertures 136, 138, 140 and 142 in the main body of interconnecting block 70 and into corresponding threaded passages in attachment block 73 which is secured to the outer surface of hydraulic cylinder 45.

From the foregoing description and from examination of the drawings, it will be seen that the interconnecting block 70 is not only securely bolted to the attachment blocks 73, 82 and 88 of the respective hydraulic cylinders 45, 49 and 51, but in addition, the interconnecting block 70 physically seats on the upper surface of attachment block 73 of the hydraulic cylinder 45 due to the seated relation of upper rear wall extension 124 of interconnecting block 70 on the upper surface of attachment block 73. Furthermore, the two outer hydraulic cylinders 49 and 51 and the mechanical load supported by those cylinders is transmitted to interconnecting block 70 due to the seated engagement of shoulders 148 and 150 of the respective attachment blocks 82 and 88 of cylinders 49 and 51 with respect to the ledges 119 and 121 formed on upper wall 102 of interconnecting block 70. Thus, the load on interconnecting block 70 is transmitted by interconnecting block 70 to hydraulic cylinder 45 of secondary hydraulic jack 41 due to the bearing relation of upper rear wall extension 124 relative to the upper surface of attachment block 73 on hydraulic cylinder 45; and the weight and mechanical load carried by hydraulic cylinders 49 and 51 is transferred to interconnecting block 70 and thus to hydraulic cylinder 45 by the bearing engagement of the shoulders 148 and 150 of the respective attachment blocks 82 and 88 associated with cylinders 49 and 51 onto the respective ledges 119 and 121 on upper wall 102 of interconnecting block 70.

From the foregoing detailed description of the invention, it has been shown how the objects of the invention have been obtained in a preferred manner. However, modifications and equivalents of the disclosed concepts, such as readily occur to those skilled in the art, are intended to be included within the scope of this invention.

The embodiments of the invention in which an exclusive property or privilege is claimed are defined as follows:

1. In combination a cluster of three hydraulic cylinders associated with the load carriage elevating and mast structure elevating functions of a fork lift truck, including a centrally disposed hydraulic cylinder and a pair of oppositely disposed hydraulic cylinders symmetrically positioned contiguous said centrally disposed hydraulic cylinder, a separate attachment block rigidly secured to the outer surface of each of the respective hydraulic cylinders, a hydraulic passage in each attachment block communicating with a hydraulic passage through the wall of its corresponding hydraulic cylinder, an interconnecting block adapted to interface with each of the three attachment blocks, said interconnecting block including hydraulic manifolding means whereby to hydraulically interconnect said hydraulic cylinders through said interconnecting block when said interconnecting block is in interfaced relation with the attachment blocks of said three hydraulic cylinders, and detachable fastening means securing said interconnecting block to the attachment blocks of said three hydraulic cylinders whereby to detachably connect each of the three cylinders of said cluster to said interconnecting block.

2. The combination defined in claim 1 in which said interconnecting block includes an overhanging shoulder which seats on the attachment block of one of said cylinders, and the attachment blocks of the other two of said cylinders are respectively formed with shoulders which seat on said interconnecting block, whereby the structural load on said interconnecting block is transferred to said one cylinder, and the structural load on said other two cylinders is transferred to said interconnecting block.

3. The combination defined in claim 2 in which said overhanging shoulder on said interconnecting block seats on the attachment block of said centrally disposed hydraulic cylinder, and the respective attachment blocks of said oppositely disposed hydraulic cylinders are respectively formed with shoulders which seat on said interconnecting block.

4. The combination defined in claim 1 in which said interconnecting block contains an internal hydraulic manifold and port means in said interconnecting block hydraulically communicating said internal hydraulic manifold with the hydraulic passage in each attachment block and with the corresponding hydraulic passages through the walls of said hydraulic cylinders, whereby to hydraulically connect each hydraulic cylinder with said internal manifold of said interconnecting block.

5. The combination defined in claim 4 including O-ring seal means at the interface between each port of said interconnecting block and the corresponding hydraulic passage in each respective attachment block.

6. The combination defined in claim 1 in which said interconnecting block includes a main body portion in which said hydraulic manifolding is contained, a pair of laterally spaced upper side wall extensions extending upwardly from the upper surface of said main body portion, a pair of laterally spaced lower side wall extensions extending downwardly from the bottom surface of said main body portion, detachable fastening means securing an upper side wall extension and a lower side wall extension contiguous one side of said main body portion to the attachment block of one of said oppositely disposed hydraulic cylinders, detachable fastening means securing an upper side wall extension and a lower side wall extension contiguous an opposite side of said main body portion to the attachment block of the other of said oppositely disposed hydraulic cylinders, and detachable fastening means extending through said main body portion in spaced relation to said manifolding means and securing said interconnecting block to the attachment block of said centrally disposed hydraulic cylinder.

* * * * *